US010703604B2

(12) United States Patent
Sonnenmoser et al.

(10) Patent No.: US 10,703,604 B2
(45) Date of Patent: Jul. 7, 2020

(54) METHOD AND CONTROL UNIT FOR CHECKING ELEVATOR SYSTEM SAFETY FUNCTIONS

(71) Applicant: Inventio AG, Hergiswil (CH)

(72) Inventors: Astrid Sonnenmoser, Hochdorf (CH); Ivo Lustenberger, Buttisholz (CH); Martin Hess, Baar (CH)

(73) Assignee: INVENTIO AG, Hergiswil NW (CH)

( * ) Notice: Subject to any disclaimer, the term of this patent is extended or adjusted under 35 U.S.C. 154(b) by 533 days.

(21) Appl. No.: 15/533,726

(22) PCT Filed: Dec. 7, 2015

(86) PCT No.: PCT/EP2015/078773
§ 371 (c)(1),
(2) Date: Jun. 7, 2017

(87) PCT Pub. No.: WO2016/091780
PCT Pub. Date: Jun. 16, 2016

(65) Prior Publication Data

US 2017/0320703 A1 Nov. 9, 2017

(30) Foreign Application Priority Data

Dec. 12, 2014 (EP) ..... 14197544

(51) Int. Cl.
*B66B 5/00* (2006.01)
*B66B 1/28* (2006.01)
(Continued)

(52) U.S. Cl.
CPC ..... *B66B 1/28* (2013.01); *B66B 1/32* (2013.01); *B66B 1/3407* (2013.01); *B66B 5/0031* (2013.01); *B66B 13/22* (2013.01)

(58) Field of Classification Search
USPC ..... 187/247
See application file for complete search history.

(56) References Cited

U.S. PATENT DOCUMENTS 5,183,978 A * 2/1993 Sheridan ..... B66B 5/04 187/288
6,173,814 B1 * 1/2001 Herkel ..... B66B 1/34 187/248
(Continued)

FOREIGN PATENT DOCUMENTS

CN 1810620 A 8/2006
CN 101152939 A 4/2008
(Continued)

*Primary Examiner* — Christopher Uhlir
(74) *Attorney, Agent, or Firm* — William J. Clemens; Shumaker, Loop & Kendrick, LLP

(57) ABSTRACT

An elevator system includes a control unit, a bus, a plurality of bus-nodes connected via the bus with the control unit, and a plurality of safety-state detection devices connected with the control unit via the bus-nodes. A method of commissioning the elevator system includes the steps: A) verification by the control unit of the safety-state detection means that are connected to the bus; B) checking of the functional capability of the safety-state detection means that are connected; C) checking by the control unit of the safety functions of the elevator system based on a change in state of a safety-state detection means; and D) release of the elevator system for a normal operation only after positive execution by the control unit of the steps A) to C), wherein the release is accompanied by a change in state of the control unit from an unsecured state into a secured state.

17 Claims, 2 Drawing Sheets

(51) Int. Cl.

| | |
|---|---|
| ***B66B 13/22*** | (2006.01) |
| ***B66B 1/32*** | (2006.01) |
| ***B66B 1/34*** | (2006.01) |

(56) References Cited

U.S. PATENT DOCUMENTS

| | | | | |
|---|---|---|---|---|
| 2011/0272216 | A1* | 11/2011 | Kugiya | B66B 5/0031 187/301 |
| 2013/0041603 | A1* | 2/2013 | Sonnenmoser | B66B 5/0037 702/58 |

FOREIGN PATENT DOCUMENTS

| | | | |
|---|---|---|---|
| CN | 102602760 | A | 7/2012 |
| EP | 1159218 | A1 | 12/2001 |
| EP | 1795481 | A1 | 6/2007 |
| WO | 0051929 | A1 | 9/2000 |
| WO | 2010097404 | A1 | 9/2010 |
| WO | 2013020806 | A1 | 2/2013 |

* cited by examiner

METHOD AND CONTROL UNIT FOR CHECKING ELEVATOR SYSTEM SAFETY FUNCTIONS

FIELD

The invention relates to a method and apparatus for the commissioning of an elevator system, and an elevator system with this apparatus.

BACKGROUND

Elevator systems are provided with monitoring devices or safety circuits. These safety circuits typically consist of safety elements which are connected in series. These safety elements can, for example, monitor the state of hoistway doors or car doors. With respect to the aforesaid, electromechanical safety circuits, or also bus-based safety circuits, are known. The safe operation of such safety circuits is regularly checked. Safety circuits and test procedures for such circuits are known, for example, from EP 1159218 A1, WO 2010/097404 A1, or WO 2013/020806 A1. However, not apparent from this prior art is whether, or to what extent, the safety of the commissioning of elevator systems is assured.

SUMMARY

It is therefore the object of the invention to propose a method and/or an apparatus with which an elevator system can be safely commissioned.

An elevator system comprises a control unit, a bus, a plurality of bus-nodes, which are connected via the bus with the control unit, and a plurality of safety-state detection means which are connected with the control unit via a bus-node.

Here, a "control unit" is to be understood as a unit which has at least one microprocessor, a working memory, and a permanent memory. Such a control unit is thus designed to execute computer-aided programs. Here, the control unit is configured as a safety control unit, which monitors safety-relevant states of the elevator system and, upon the occurrence of an unsafe state, returns the elevator system to a safe state. This comprises, for example, the monitoring of the hoistway-door states, wherein the elevator system is shut down if a hoistway door is standing open and no elevator car is standing at the floor that is assigned to the hoistway door.

Here, "safety-state detection means" are to be understood as sensors, or switching contacts, which monitor a safety-relevant state of the elevator system. These include position, velocity, and acceleration sensors, which monitor a movement-state of an elevator car, as well as switching contacts, which monitor a hoistway- or car-door state or the overrunning of a permissible end-position by the elevator car. This list is not exhaustive.

According to the invention, during a commissioning of the elevator system, the control unit proceeds through the following steps:

A) verification by the control unit of the safety-state detection means that are connected to the bus, B) checking by the control unit of the functional capability of the safety-state detection means that are connected to the bus, C) checking by the control unit of the safety functions of the elevator system based on a change of state of a safety-state detection means; and D) release by the control unit of the elevator system for a normal operation only after positive completion of steps A) to C), wherein the release of the normal operation is accompanied by a change of state of the control unit from an unsecured state to a secured state.

During the verification in Step A), the control unit surveys, for example, all safety-state detection means that are connected to the bus and compares these with a saved expectation. Alternatively thereto, the safety-state detection means can be manually registered in the control unit by an installation technician. After Step A), as a result of the comparison or manual registration, a verified inventory of all safety-state detection means that are connected to the bus is extant.

During the checking of the functional capability of the connected safety-state detection means, the control unit brings about a virtual, or real, change of state of the elevator system and verifies whether the signals that are emitted by the safety-state detection means correspond with the change of state. For example, the control unit causes the elevator car to be driven to a certain floor. Hereby, upon arrival at that certain floor, an opening of the hoistway door can be provoked. In the event of a faultless functional capability of the safety-state detection means that monitors the hoistway door, the means transmits a signal that indicates the open state of the hoistway doors to the control unit. Alternatively, the control unit can virtually simulate a travel of the elevator car to a particular floor. The control unit proceeds correspondingly for all safety-state detection means that are to be checked. If the signals that are transmitted by the safety-state detection means are identical with the expectation(s) of the control unit, the Step B) counts as positively completed.

When checking the safety functions of the elevator system, the control unit goes a step further and brings about an inadmissible state. This inadmissible state that is generated can be either virtual or real. In the case of an inadmissible state, not only must the signals that are transmitted by the safety-state detection means match the expectation of the control unit, but a corresponding response to the inadmissible state, to return the elevator system to a safe state, must also be detected. For example, in the event of a movement of the elevator car with hoistway doors standing open, an emergency braking must be triggered by the control unit. When for all conceivable inadmissible states a corresponding response has been registered, the Step C) counts as positively completed.

When all of the steps A) to C) have been positively completed, the elevator system can be released for normal operation. Hereupon, the control unit changes from an unsecured state into a secured state. As long as the control unit is in an unsecured state, in other words during the steps A) to C), the control unit can be configured. If the control unit adopts the secured state, a configuration of the control unit is ruled out. In this secured state, the control unit can only be brought into different operating modes. These operating modes comprise at least a normal operating mode and a maintenance mode. Optionally, the control unit can also contain an inspection mode, an evacuation mode, or further special operating modes.

An advantage of the method according to the invention is that, by means of the control unit, the transition from commissioning to the normal operating mode proceeds in defined manner. The steps A) to C) require clear conditions which must be fulfilled before the elevator system can be put into the normal operating mode. The elevator system can thus be safely put into operation.

Through the adoption of an assured state of the control unit, the operating safety is further increased, since, in this state, an unintentional modification of the program of the control unit, or an unintentional addition or removal of bus-nodes, is ruled out. Should an installation technician wish to connect additional bus-nodes with the bus, the control unit must therefore be returned to the unsecured state by means of entering a special command. Also, a new release of the elevator system for a normal operating mode is only possible after the steps A) to C) have been executed.

Further, for the purpose of braking an elevator car, the elevator system has an emergency brake. The emergency brake is, for example, designed as a drive brake, which counteracts a rotational movement of the drive shaft of the drive. By this means, the braking effect of the drive brake is transmitted from the drive shaft, through a traction sheave and a suspension means, to the elevator car. The emergency brake can be triggered by the control unit.

Preferably, the checking of the safety functions in Step C) contains a triggering of the emergency brake caused by an inadmissible movement-state of the elevator car and/or an inadmissible state of the car doors or hoistway doors. In particular, the emergency brake is triggered by an inadmissible velocity, an unintentional movement of the elevator car with an open state of the hoistway doors, an overrunning of a final-limit switch, an inadmissible acceleration, an inadmissible open state of the hoistway doors, or an inadmissible open state of the car doors.

Further, for the purpose of braking the elevator car, the elevator system has a safety gear. The safety gear is arranged on the elevator car and acts on a guiderail of the elevator car to bring the elevator car to a standstill. The safety gear can also be triggered by the control unit.

Optionally, or additionally, the checking of the safety functions in Step C) contains a triggering of the safety gear on account of an inadmissible movement-state of the elevator car and/or of an inadmissible state of the car doors or hoistway doors. In particular, the safety gear is triggered by an inadmissible velocity, an unintentional movement of the elevator car with an open state of the hoistway doors, an overrunning of a final-limit switch, an inadmissible acceleration, an inadmissible open state of the hoistway doors, or an inadmissible open state of the car doors.

Self-evidently, also further safety functions can be checked, as, for example, a safety-relevant braking of the elevator car by addressing a frequency converter. The above examples of checking the safety functions are to be understood as purely exemplary and do not constitute an exhaustive treatment of the Step C).

Preferably, the inadmissible movement-state of the elevator car and/or the inadmissible state of the car doors or of the hoistway doors is virtually generated by the control unit in that at least one fault signal is transmitted from the control unit to a bus-node.

Alternatively thereto, the inadmissible movement-state of the elevator car and/or the inadmissible state of the car door or hoistway door is generated by the control unit, in that the elevator car and/or the car doors or the hoistway doors is/are brought by the control unit into an inadmissible movement-state and/or an inadmissible state.

Further, for the purpose of entering control commands to the control unit, the elevator system has an interface. The interface can be embodied as a keyboard or as a touch-sensitive screen, through which a control command, or a code in the form of a combination of figures, and/or a sequence of letters, can be entered.

Preferably, on the one hand, the input of configuration commands to the interface is only accepted by the control unit in the unsecured state, on the other hand, the input of configuration commands through the interface in the secured state is rejected by the control unit.

Here, "configuration commands" are to be understood as commands to the control unit, with which the number of bus-nodes and/or the type of the state-detection means can be registered.

Preferably, in the secured mode of the control unit, only predefinable operating modes are released which comprise a normal operation, a maintenance operation, or an inspection mode.

A further aspect of the invention relates to an apparatus for the execution of the method and an elevator system with the said apparatus.

DESCRIPTION OF THE DRAWINGS

The invention is described more fully below by reference to exemplary embodiments. Shown are in FIG. 1 schematically, an exemplary arrangement of an elevator system according to the invention; and in FIG. 2 a flow-chart of the process-steps of the method according to the invention.

DETAILED DESCRIPTION

Figure 1:
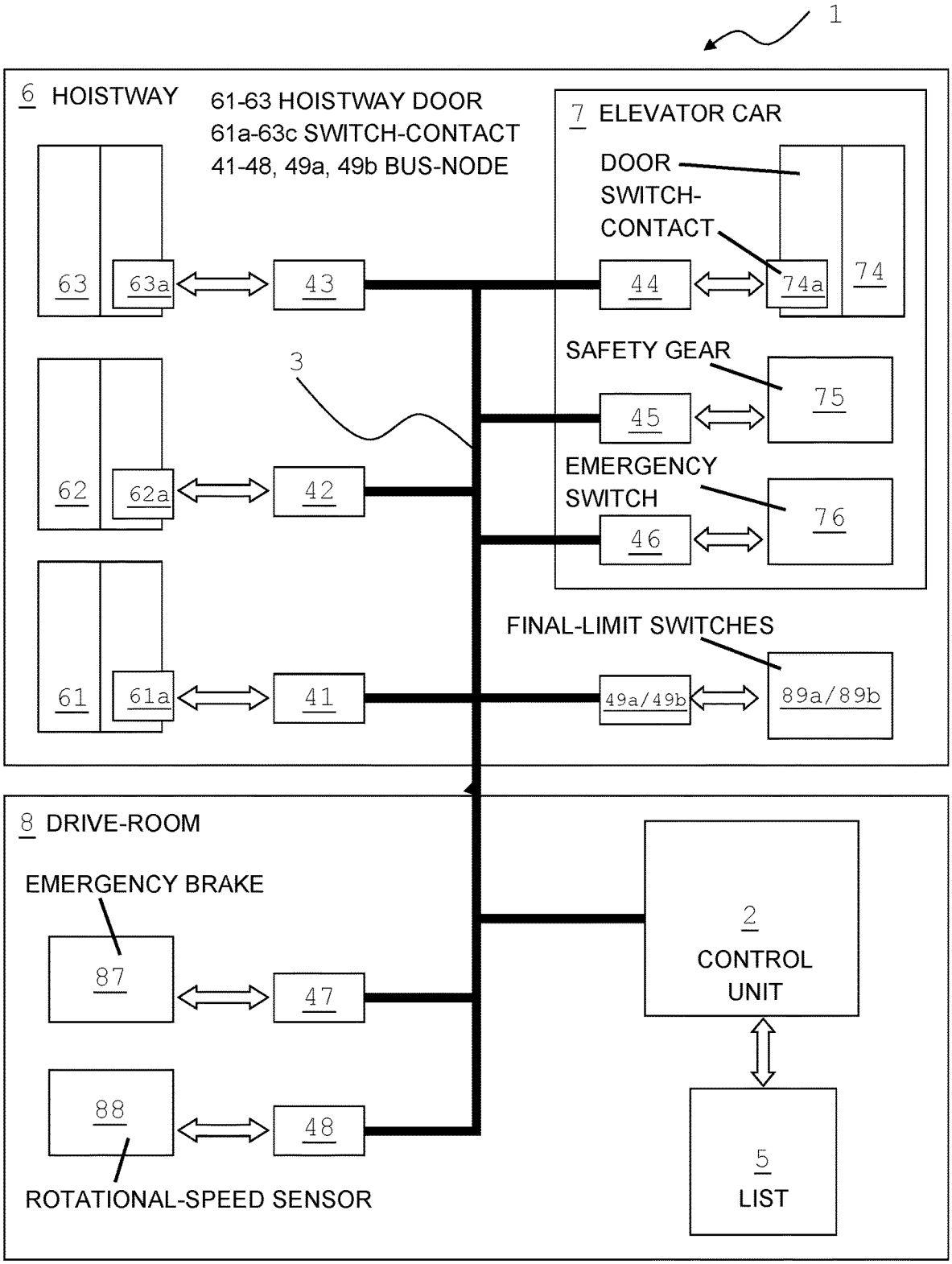

The elevator system 1 which is depicted schematically in FIG. 1 comprises a control unit 2, which, through a bus 3, is connected with a plurality of bus-nodes 41 to 48 and 49*a*, 49*b*. As shown in FIG. 1, the control unit 2 can be arranged in a separate drive-room 8. In a preferred embodiment, the control unit 2 is arranged in the hoistway 6.

Indicated with reference number 6, and depicted schematically, is a hoistway 6 of a building, into which the elevator system 1 is built. Exemplarily, the building has three floors and each floor is equipped with a hoistway door 61, 62, 63. Assigned to the bus-node 41 is the hoistway door 61, to the bus-node 42 the hoistway door 62, and to the bus-node 43 the hoistway door 63.

Assigned to the respective bus-nodes 41, 42 or 43 is a safety-state detection means or device, here, for example, a switch-contact 61*a*, 62*a*, 63*a*, which registers information about the state of the assigned hoistway door 61, 62 or 63 (open, closed, locked) and, if necessary, can generate a fault message for the control unit 2.

The elevator system 1 further has an elevator car 7. The elevator car 7 is equipped with an elevator door 74, which is also connected with a bus-node 44. Assigned to the bus node 44 is a further safety-state detection means or device, for example a further switch-contact 74*a*, which detects items of information about the state of the assigned elevator door 74 (open, closed, locked) and can, if necessary, generate a fault message for the control unit 2.

The elevator system 1 can further have a bus-node 45 and a bus-node 46, which are assigned to a safety gear 75 and an emergency switch 76 respectively, which are here arranged in the elevator car 7. The safety gear 75 serves to safely brake the elevator car 7, for example in the event of an overspeed of the latter being attained.

In an emergency situation, through actuation of the emergency switch 76, the elevator system 1 can be brought to an immediate standstill.

Further, arranged in a drive-room 8 is a drive unit which is equipped with an emergency brake 87 and a further safety-state detection means or device, for example a rotational-speed sensor 88, which are assigned to a bus-node 47 and 48 respectively. In a preferred embodiment, the drive unit is arranged in the hoistway 6, whereby a separate drive-room is obviated.

Provided in the hoistway 6 are further safety-state detection means or device, here two final-limit switches 89*a*, 89*b*, which limit a travel of the elevator car 7 at the ends of the hoistway 6. For reasons of clarity, in FIG. 1 the final-limit switches 89*a*, 89*b* are depicted together. One of the final-limit switches 89*a*, 89*b* may be arranged in the pit area of the hoistway 6, while the other final-limit switch 89*a*, 89*b* may be arranged in the hoistway-headroom area of the hoistway 6. Each of the final-limit switches 89*a*, 89*b* is connected via a bus-node 49*a*, 49*b* with the bus 3. Should the elevator car 7 overrun one of the final-limit switches 89*a*, 89*b*, the respective final-limit switch 89*a*, 89*b* changes its state and a fault message is sent to the control unit 2. In response to this fault message, by means of the emergency brake 75, the control unit 2 brings the elevator car 7 to a standstill.

Figure 2:
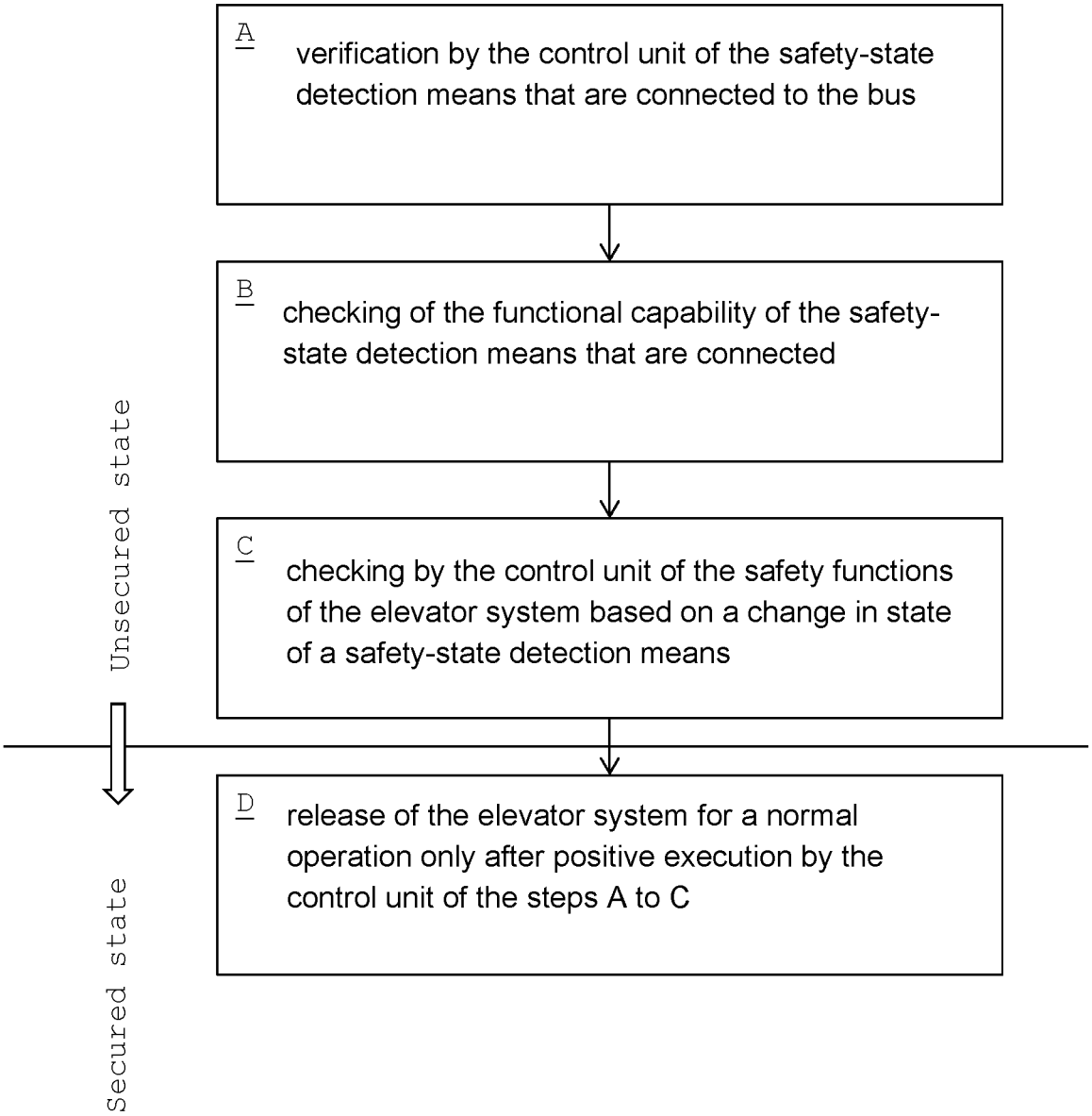

In a commissioning of an elevator system 1, the control unit 2 verifies according to the process-step A of FIG. 2 the bus-nodes 41 to 48 and 49*a*, 49*b* which are built into the elevator system and are active, and/or the connected safety-state detection means 61*a*, 62*a*, 63*a*, 74*a*, 88, 89*a*, 89*b*, and the node-specific data of each bus-node 41 to 48 and 49*a*, 49*b*. Here, "node-specific data" are to be understood as data about the bus-node addresses or data of the state-detection means that are connected to the bus-nodes. The data that are detected are stored by the control unit.

Then, by means of the control unit 2, the detected node-specific data are automatically compared with a participant list 5, which in this exemplary embodiment is empty. For this reason, in the absence of a match with the participant list 5, for each detected bus-node 41 to 48 and 49*a*, 49*b*, an inquiry is sent to a technician who is responsible for the commissioning of the elevator system 1, as to whether or not the respective detected bus-node 41 to 48 and 49*a*, 49*b* should be saved in the participant list.

In the event that the detected bus-node 41 is confirmed, the technician receives a new message to save a further detected bus-node, for example the bus-node 42. In the event of a termination, the technician can restart the commissioning or edit the participant list.

Here, the registering of node-specific data and its comparison with a list is referred to as "verification".

Subsequently, the bus-node 41 and/or the safety-state detection means 61*a* that are attached thereto, which are stored in such manner in the participant list 5, can be subjected to a check of the functional capability according to the process-step B of FIG. 2. The control unit 2 controls the hoistway door 61 and leaves the latter open. The safety-state detection means 61*a* that is assigned to the bus-node 41 registers the opening of the hoistway door 61 and notifies this change of state to the control unit 2. Through the notified change of state, the functional capability of the bus-node 41 and of the assigned safety-state detection means 61*a* is thereby checked.

The control unit 2 can, for example, also instruct the drive unit to cause the elevator car 7 to travel to the second floor. During the travel to the second floor, the control unit 2 receives from the bus-node 48 node-specific data from the rotational-speed sensor 88 about the rotational speed of the motor, which indicate a movement of the elevator car 7.

When the elevator car 7 has reached the desired floor, the elevator door 74 opens simultaneous with the hoistway door 62. The respective bus-nodes 44, 42 and/or the respective safety-state detection means 74*a*, 62*a*, notify to the control unit 2 the change of state, which confirms the functional capability of the two bus-nodes 42 and 44 and of the assigned safety-state detection means 62*a*, 74*a*. The other floors proceed correspondingly.

In similar manner, in order to test the functional capability of the bus-node 49*a*, 49*b* and/or of the safety-detection means 89*a*, 89*b*, the control unit 2 can instruct the drive unit to cause the elevator car 7 to travel beyond one of the final-limit switches 89*a*, 89*b*.

To test the safety function according to the process-step C of FIG. 2, for example, an actuation of the emergency switch 76 by the control unit 2 is simulated and, through a corresponding notification of node-specific data of the bus-nodes 47 and 48, it is determined whether the emergency brake 87 immediately brings the elevator car 7 to a standstill.

Further, the control unit 2 can simulate the detection by the rotational-speed sensor 88 of an overspeed of the elevator car 7 and provoke a triggering of the safety gear 75. Correspondingly, from the assigned bus-node 45 a notification of the state of the safety gear 75 is transmitted to the control unit 2. The triggering of the safety gear 75 is hereby confirmed.

After successful completion of the three process-steps A, B, C, namely "Verification of the safety-state detection means", "Checking of the functional capability", and "Checking of the safety functions", a message is issued to release the elevator system 1 for normal operation according to Process Step D of FIG. 2. This release is accompanied by a change of state of the control unit 2 from an unsecured state to a secured state.

The previously described three process-steps A, B, C, which precede the release D of the elevator system 1, take place in an unsecured state of the control unit 2. By contrast, in the secured state of the control unit 2, the control unit 2 can no longer be manipulated. In the latter state, the control unit 2 only accepts control commands to change the operating mode. Thereby, for example, the control unit 2 can be brought from a normal mode into a maintenance mode and vice versa.

In the event of a modernization of the elevator system 1, modifications to the configuration of the control unit 2 can again be enabled. For this purpose, by means of the entry of a special command, the control unit 2 is again brought into the unsecured state. In the course of a modernization, the number of bus-nodes, and/or the type of the state-detection means, can be adapted within a predefined range. For example, in addition to the rotational-speed sensor 88, or as replacement thereof, an absolute-positioning sensor could be provided, which is arranged on the elevator car 7. After the installation of the absolute-positioning sensor and the creation of the connection with the bus 3, the control unit 2 verifies its node-specific data, checks its functional capability, and checks the safety functions in conjunction with the absolute-positioning sensor. Only after execution of the three process-steps A, B, C is a message again sent to release the elevator system 1 for a normal operation according to Process Step D. The control unit 2 is hereby returned to its secured state.

Self-evidently, depending on the design of the elevator system 1, a plurality of control units or additional state-detection means can be provided. If the spatial arrangement of the state-detection means permits, also a plurality of state-detection means can be connected to a common bus-node with the bus 3. The concept of the invention is not restricted to the exemplary embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for commissioning an elevator system having a control unit, a bus, a plurality of bus-nodes being connected via the bus with the control unit, and a plurality of safety-state detection devices each being connected with the control unit via one of the bus-nodes, wherein the method comprises the steps of:

A) verification by the control unit of the safety-state detection devices that are connected to the bus;

B) checking by the control unit of a functional capability of each of the safety-state detection devices that is connected to the bus;

C) checking by the control unit of safety functions of the elevator system based upon a change of state of at least one of the safety-state detection devices by the control unit;

D) release of the elevator system for a normal operation only after positive execution by the control unit of the steps A) to C), wherein the release for the normal operation is accompanied by a change of state of the control unit from an unsecured state to a secured state; and E) wherein the elevator system includes an interface for entering configuration commands to the control unit and wherein the entry of the configuration commands at the interface is at least one of only accepted in the unsecured state of the control unit and reiected in the secured state of the control unit.

2. The method according to claim 1 wherein the elevator system includes an emergency brake to brake an elevator car, the emergency brake being triggered by the control unit, and wherein the checking of the safety functions in the Step C) includes a triggering of the emergency brake in response to at least one of an inadmissible movement-state of the elevator car and an inadmissible state of a car door or of a hoistway door.

3. The method according to claim 2 wherein the triggering of the emergency brake is in response to at least one of an inadmissible velocity of the elevator car, an unintentional movement of the elevator car with open state of the hoistway door, an overrunning of a final-limit switch by the elevator car, an inadmissible acceleration of the elevator car, an inadmissible open state of the hoistway door, and an inadmissible open state of the car door.

4. The method according to claim 2 wherein at least one of the inadmissible movement-state of the elevator car and the inadmissible state of the car door or of the hoistway door is virtually generated by the control unit and at least one fault signal is transmitted from the control unit to one of the bus-nodes.

5. The method according to claim 2 wherein at least one of the inadmissible movement-state of the elevator car and the inadmissible state of the car door or of the hoistway door is generated by the control unit, wherein the elevator car, the car door or the hoistway door is brought by the control unit into an inadmissible movement state or an inadmissible state.

6. The method according to claim 1 wherein the elevator system includes a safety gear for braking an elevator car, wherein the safety gear is triggered by the control unit, and wherein the checking of the safety functions in the Step C) includes triggering the safety gear in response to at least one of an inadmissible movement state of the elevator car and an inadmissible state of a car door or a hoistway door.

7. The method according to claim 6 wherein the triggering of the safety gear is in response to at least one of an inadmissible velocity of the elevator car, an unintentional movement of the elevator car in open state of the hoistway door, an overrunning of a final-limit switch by the elevator car, an inadmissible acceleration of the elevator car, an inadmissible open state of the hoistway door, and an inadmissible open state of the car door.

8. The method according to claim 6 wherein at least one of the inadmissible movement-state of the elevator car and the inadmissible state of the car door or of the hoistway door is virtually generated by the control unit and at least one fault signal is transmitted from the control unit to one of the bus-nodes.

9. The method according to claim 6 wherein at least one of the inadmissible movement-state of the elevator car and the inadmissible state of the car door or of the hoistway door is generated by the control unit, wherein the elevator car, the car door or the hoistway door is brought by the control unit into an inadmissible movement state or an inadmissible state.

10. The method according to claim 1 wherein, in the secured state, only predefinable operating modes are released by the control unit including at least one of a normal operation mode, a maintenance operation mode, and an inspection mode.

11. An apparatus for commissioning an elevator system having a control unit, a bus, a plurality of bus-nodes being connected via the bus with the control unit, and a plurality of safety-state detection devices each being connected with the control unit via one of the bus-nodes, comprising:

the control unit being configured to only release the elevator system for a normal operation when the control unit has verified the safety-state detection devices that are connected to the bus, to check a functional capability of the safety-state detection devices that are connected to the bus, and, based on a change in state of any of the safety-state detection devices, checks safety functions of the elevator system, wherein the release of the normal operation is accompanied by a change in state of the control unit from an unsecured state into a secured state; and an interface for entry of configuration commands to the control unit, wherein the control unit at least one of accepts the entry of the configuration commands at the interface in the unsecured state and, in the secured state, rejects the entry of the configuration commands at the interface.

12. The apparatus according to claim 11 including an emergency brake for braking an elevator car, wherein the emergency brake is triggered by the control unit, wherein the checking of the safety functions, on account of at least one of an inadmissible movement-state of the elevator car and an inadmissible state of a car door or of a hoistway door, causes the control unit to trigger the emergency brake.

13. The apparatus according to claim 12 wherein the triggering is in response to at least one of an inadmissible velocity of the elevator car, an unintentional movement of the elevator car in an open state of the hoistway door, an overrunning of a final-limit switch by the elevator car, an inadmissible acceleration of the elevator car, an inadmissible open state of the hoistway door, and an inadmissible open state of the car door.

14. The apparatus according to claim 11 including a safety gear for braking an elevator car, wherein the safety gear is triggered by the control unit, wherein the checking of the safety functions, on account of at least one of an inadmissible movement-state of the elevator car and an inadmissible state of a car door or a hoistway door, causes the control unit to trigger the safety gear.

15. The apparatus according to claim 14 wherein the triggering is in response to at least one of an inadmissible velocity of the elevator car, an unintentional movement of the elevator car in an open state of the hoistway door, an overrunning of a final-limit switch by the elevator car, an inadmissible acceleration of the elevator car, an inadmissible open state of the hoistway door, and an inadmissible open state of the car door.

16. The apparatus according to claim 11 wherein, in the secured state, the control unit only releases predefinable operating modes that include at least one of a normal operation mode, a maintenance operation mode, and an inspection mode.

17. An elevator system including the apparatus according to claim 11.

* * * * *